United States Patent [19]

Bruce

[11] 4,134,356

[45] Jan. 16, 1979

[54] ANCHORS

[76] Inventor: Peter Bruce, "De Victoria"App. 5e etage - Bloc D, 13 bd Princesse Charlotte, Monte Carlo, Monaco

[21] Appl. No.: 694,485

[22] Filed: Jun. 9, 1976

[30] Foreign Application Priority Data

Jun. 13, 1975 [GB] United Kingdom ..... 25295

[51] Int. Cl.[2] ..... B63B 21/24

[52] U.S. Cl. ..... 114/301

[58] Field of Search ..... 114/207, 208 R, 300, 114/301, 303, 304, 309

[56] References Cited

U.S. PATENT DOCUMENTS

| | | | |
|---|---|---|---|
| 2,738,750 | 3/1956 | Vorenkamp | 114/207 |
| 3,712,259 | 1/1973 | Semolic | 114/303 X |
| 3,716,012 | 2/1973 | Wright | 114/207 |
| 3,777,695 | 12/1973 | Bruce | 114/207 |

FOREIGN PATENT DOCUMENTS

| | | | |
|---|---|---|---|
| 2352144 | 4/1975 | Fed. Rep. of Germany | 114/304 |

*Primary Examiner*—Stanley H. Tollberg
*Assistant Examiner*—Edward M. Wacyra
*Attorney, Agent, or Firm*—Mason, Fenwick & Lawrence

[57] ABSTRACT

An anchor includes a fluke attached to a shank having a forwardly located cable attachment point. The fluke includes concave side surfaces, and these side surfaces can serve to orientate the anchor to an upright burial position by interaction with the sea bed and to stabilize the anchor when buried in the sea bed. The fluke side surfaces are also arranged, either by relative orientation thereof or by the inclusion of a flat fluke portion interconnecting the side surfaces, such that, when the anchor is pulled through the sea bed, the peak pressure focus zone produced by the sea bed soil on interaction of the fluke with the soil is located clear of the shank and clear of the forward path of burial movement of the shank.

16 Claims, 9 Drawing Figures

ANCHORS

The present invention relates to an anchor for mooring an object to a mooring bed; for example, for mooring a vessel or other floating body such as a drilling rig to the sea bed, the anchor including a fluke having a burial surface thereon which in a vertical working burial attitude of the anchor is inclined relative to the horizontal to be penetrable into the mooring bed when dragged thereover whereby forces are developed by the burial surface to cause burial of the anchor, and a shank member located in a fore-and-aft plane of symmetry of the anchor and attached to the fluke and having an end adapted as a cable attachment point, the fluke having portions curved or bent transversely to give the fluke overall a substantially concave upwards-facing working surface. Such an anchor is hereinafter referred to as an anchor of the type aforesaid. Examples of such anchors are described in the present applicant's U.S. Pat. No. 3,777,695 and in Danish Pat. No. 59966.

The anchor of U.S. Pat. No. 3,777,695 is arranged to give roll stability while the anchor is being dragged through the sea bed soil while the fluke configuration of Danish Pat. No. 59966 is arranged to provide the facility of snug stowing against convexly curved ships' bows. However, a disadvantage of these anchors is the inherent capacity of the concave fluke to focus and so increase the interparticle pressure of the sea bed soil immediately adjacent the shank, so as to greatly increase the resistance of the soil to penetration by the shank which reduces the ability of the anchor to bury deeply and develop high holding power by interacting with a large overburden of sea bed soil. In both of the examples mentioned of anchors of the type aforesaid, the fluke establishes an increased pressure zone immediately around the shank and in the forward path of movement of the shank. By the term "pressure focus zone" (in relation to a mooring bed) is hereinafter meant the zone in the mooring bed to which are focused the pressure vectors created during anchor burial by interparticle reaction in the bed due to the reaction with the bed of the fluke portion to one side of the anchor's fore-and-aft plane of symmetry.

It is an object of the present invention to obviate or mitigate this disadvantage.

According to the present invention, in an anchor of the type aforesaid, the fluke portion located at one side of the plane of symmetry of the anchor is arranged such that, when the anchor is pulled through the mooring bed in a vertical burial attitude, the peak pressure focus zone produced in the mooring bed soil by the working surface of the fluke portion, due to relative movement and consequent impingement of the soil thereon, is located substantially clear of the shank member and clear of the forward path of burial movement to be followed by the shank member in the soil.

Preferably, where the centres of peak pressure focus zones produced by the fluke portion on each side of the plane of symmetry are not coincident above the shank member, the lateral separation of the centres of peak pressure in any cross-section of anchor and soil normal to the plane of symmetry is not less than 1.15 times the width of the shank in such cross-section.

In particular, according to the present invention the working surface of each fluke portion of the anchor to one side of the symmetry plane is arranged so that the centre of concave curvature of substantially all of the centres of concave curvature of sections of the working surface of said fluke portion or portions lying in the planes normal to the central plane of symmetry are laterally spaced from the shank member on that fluke portion side of the anchor.

An embodidment of the present invention will now be described by way of example with reference to the accompanying drawings in which:

FIG. 1 shows a side elevational view of an anchor according to the present invention;

FIG. 2 shows a schematic front view of a previous anchor as shown in U.S. Pat. No. 3,777,695 and Danish Pat. No. 59966.

Figure 1:
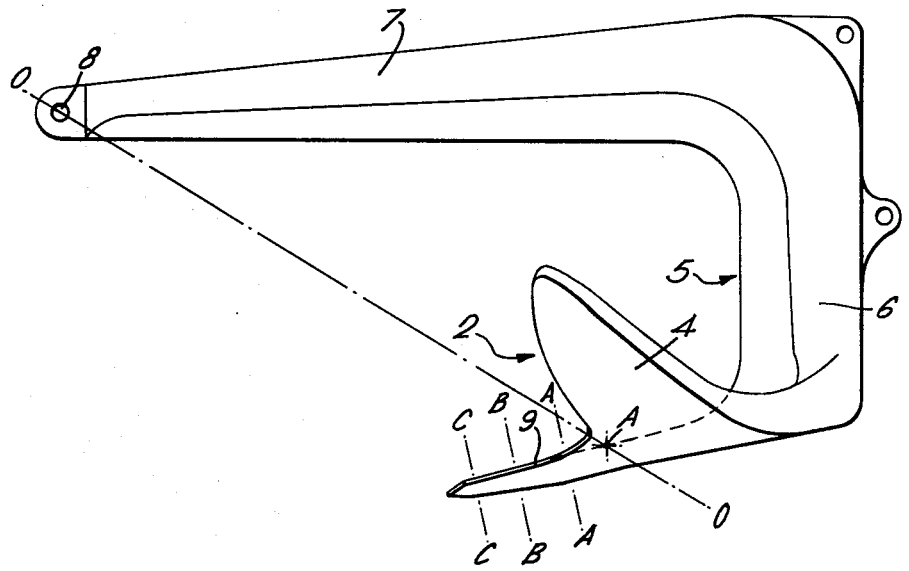
Figure 2:
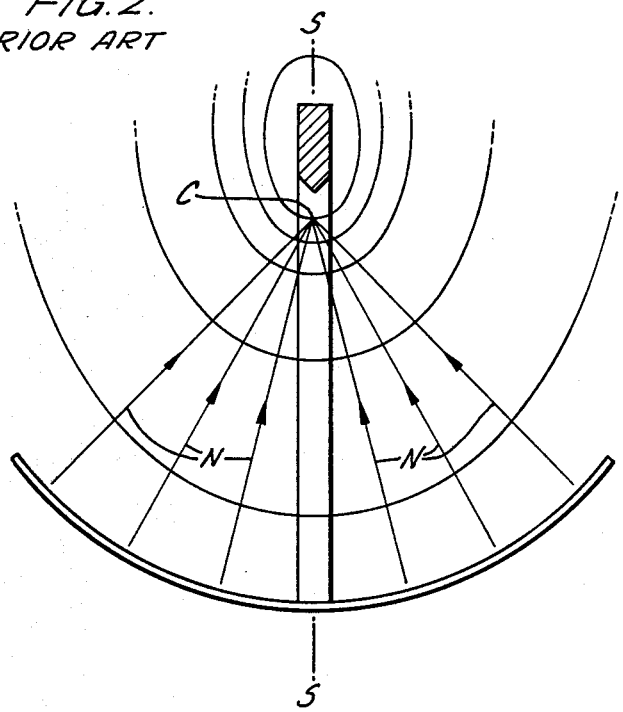
FIG. 2. PRIOR ART

Referring to FIGS. 1 and 2, an anchor 1 as described in the applicant's U.S. Pat. No. 3,777,695, includes a fluke 2, having curved side arm portions 3, 4 giving the fluke overall an upwards-facing concave working surface, and a generally L-shaped shank 5 having one, shorter, limb 6 secured at the rear of the fluke 2 so as to be upstanding therefrom with the other, longer, limb 7 extending forwardly and having its free end 8 adapted as a cable attachment point. As explained and claimed in U.S. Pat. No. 3,777,695, the side arms 3, 4 are arranged both to roll the anchor (if necessary) into a vertical working burial attitude by interaction of an arm with the mooring bed soil and to roll-stabilise the anchor in this vertical attitude during subsequent burial of the anchor 1 below the mooring bed surface. Referring to FIG. 2, the roll-stabilisation effect is achieved basically by having the bulk of the normals from the upper working surface of each arm 3, 4 intersect the plane of symmetry S—S of the anchor 1 above the line O—O (FIG. 1) connecting the cable attachment point 8 and the centre of area A of the fluke (i.e. above the roll axis of the anchor).

Figure 5:
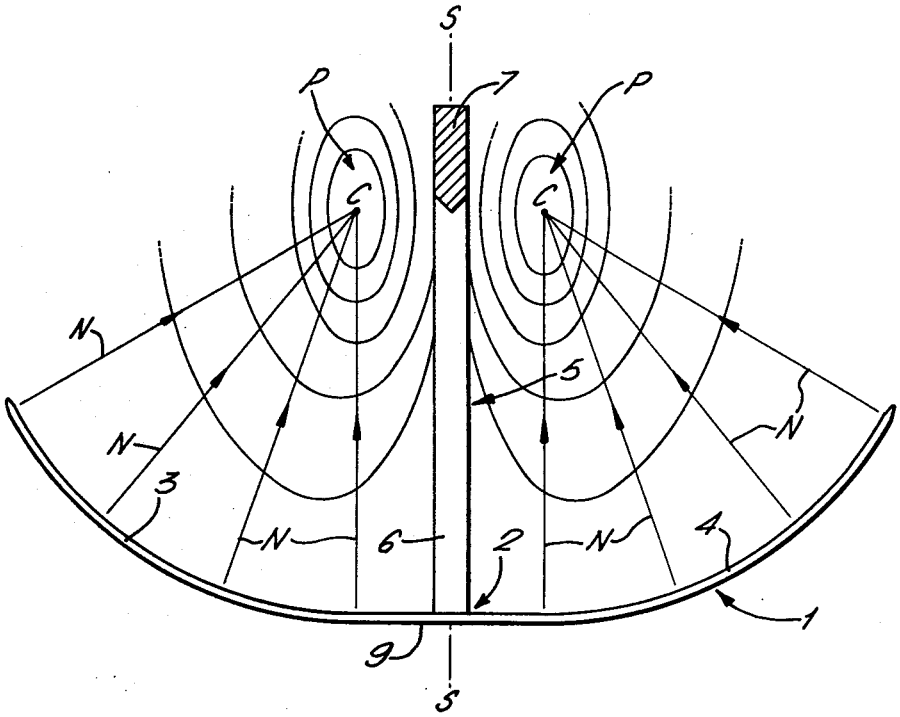
FIG. 5 shows a diagrammatic front view of the anchor of FIG. 1.
Figure 6:
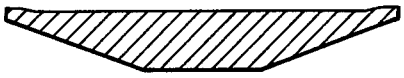
FIG. 6 shows a section through A—A of the anchor fluke in FIG. 1.
Figure 7:
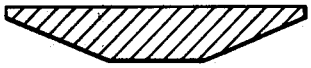
FIG. 7 shows a section through B—B of the anchor fluke of FIG. 1.
Figure 8:
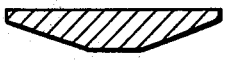
FIG. 8 shows a section through C—C of the anchor fluke of FIG. 1.

In the present anchor shown in FIGS. 1 and 5, each half fluke 3, 4 to one side of the anchor's fore-and-aft plane of symmetry S—S has a curved concave portion so arranged and located that the centres C of concave curvature (or the bulk of the centres C of concave curvature where there are more than one) of sections of the working surface located on that half fluke side of the anchor in planes normal to the intercept of the working surface of the fluke with the central plane of symmetry S—S of the anchor are laterally spaced from the shank 5. In a corresponding previous anchor according to U.S. Pat. No. 3,777,695, these centres of concave curvature C were located substantially in the central plane of symmetry of the anchor immediately below the limb 7 of the shank as shown in FIG. 2. In comparison, it has been found that the present anchor 1 achieves greater depths of burial and allows higher cable tensions to be developed. The peak pressure zone P in the mooring bed caused by the reaction of the concave portion of the surface of each half fluke 3, 4 with the bed during anchor burial may be considered to be located approximately at the centre of curvature C (or mean centre of curvature) of the concave surface, the pressure vectors substantially coinciding with the normals, and since the present arrangement, unlike the previous, ensures that said pressure zone P is substantially outwith the path of advance of the shank 5 during anchor burial, burial is not unduly impeded by the pressure zones P. The pressure distribution in the bed adjacent the anchor 1 is indicated in FIG. 5.

For a 3000 Kg anchor having a shank width of about 150 mm at the pertinent location, the centre of curvature C (or mean centre of curvature) of each arm can be laterally spaced about 23 mm from the shank.

Figure 3:
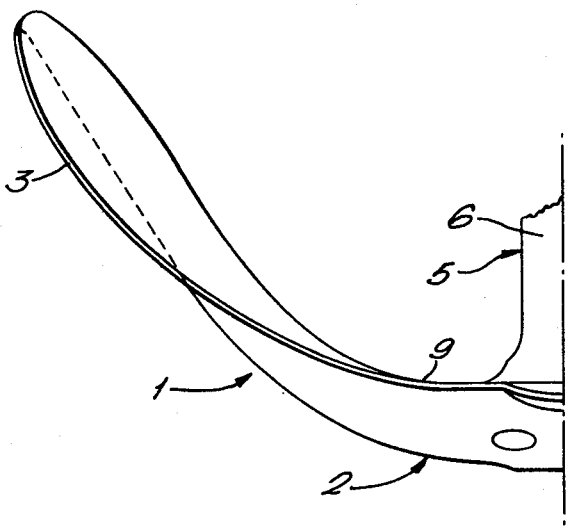
FIG. 3 shows a partial front view of the anchor of FIG. 1.
Figure 4:
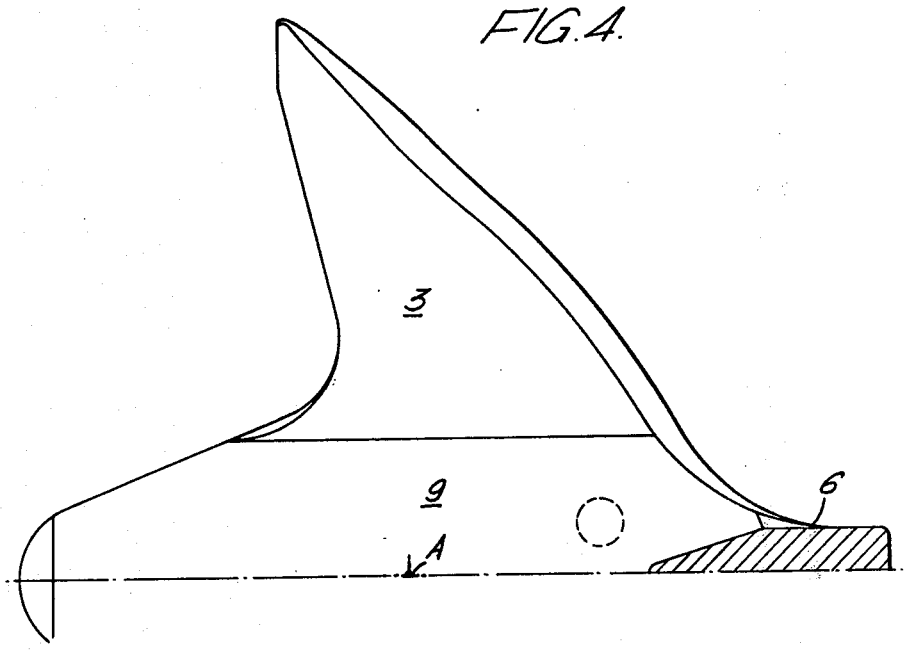
FIG. 4 shows a plan view in part section of part of the anchor of FIG. 1.

The present anchor can be produced by modifying the design of the said previous anchor according to U.S. Pat. No. 3,777,695 (FIG. 2) so that each half fluke 3, 4 is rotated outwards a few degrees about the intersection of its working surface with the central plane of symmetry (S—S) so that the mean centres of concave curvature C are laterally spaced from the shank 5. Alternatively as shown in FIGS. 3 to 5, each half fluke can be shifted laterally by the insertion of a flat central portion 9 in the fluke 2 so that a lateral separation of the mean centres C of concave curvature is achieved. Advantageously such a flat central portion 9 causes no pressure focussing and may preferably be arranged to have a slight upwards V formation of very small gradient ((1/92) approx.) to assist casting when the anchor is manufactured by separately casting the central fluke 9 and shank 5 as one piece and then welding the concave portions 3, 4 to the central fluke portion 9.

Distance between the centres of pressure zones P in any transverse plane normal to the fore-and-aft centre line of the fluke exceeds the shank section width in that plane by at least 15% with 30% or even 40% envisaged. Since shear failure surfaces (slip planes) emanate from the leading edge, the focussing effect will be greatest from the fluke surfaces nearest to the leading edges. The greatest contribution to pressure focussing may be from the inboard portions of the fluke.

Figure 9:
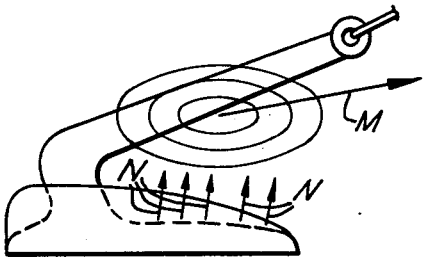
FIG. 9 shows a side view of an anchor according to another embodiment of the present invention, comprising a modification of the anchor shown in Danish Pat. No. 59966.

The fluke 2 of the anchor of Danish Pat. No. 59966 shown in FIG. 9 can be arranged similarly so that the pressure centres P are displaced laterally from the shank. The arrowed line M in FIG. 9 indicates the path of movement of the anchor.

Whereas the above embodiment describes an anchor particularly satisfying U.S. Pat. No. 3,777,695 and Danish Pat. No. 59966, it will be understood that the invention is readily applicable to other anchors having flukes of overall upwardly concave aspect.

I claim:

1. An anchor including a fluke having a burial surface thereon which in a vertical working burial attitude of the anchor is inclined relative to the horizontal to be penetrable into a mooring bed when dragged thereover whereby forces are developed by the burial surface to cause burial of the anchor, and a shank member located in a fore-and-aft plane of symmetry of the anchor and attached to the fluke and having an end adapted as a cable attachment point, the fluke having at either side of said plane of symmetry side portions with substantially cylindrical upper working surfaces, upwardly extending normals from said working surfaces intercepting said plane of symmetry such that the fluke has a substantially concave upwardly facing working surface, the centres of curvature of transverse sections of said fluke side portions being located outside the part of the plane of symmetry which lies below and forward of at least a portion of the shank member so that, when the anchor is pulled through the mooring bed in a vertical burial attitude, the centre of the peak pressure focus zone produced in the mooring bed soil by the upper working surface of each fluke side portion, due to relative movement and consequential impingement of the soil thereof, is located substantially clear of the shank member and clear of the forward path of burial movement to be followed by the shank member in the soil.

2. An anchor according to claim 1, wherein the centres of the peak pressure focus zones produced by the fluke side portions on each side of the plane of symmetry are laterally separated about the said plane of symmetry.

3. An anchor according to claim 2, wherein the lateral separation of the centres of peak pressure in any cross-section of anchor and soil normal to the intercept of the working surface of the fluke with the central plane of symmetry is not less than 1.15 times the width of the shank member in such cross-section.

4. An anchor according to claim 3, wherein said lateral separation is approximately 1.30 times said width of the shank member.

5. An anchor according to claim 3, wherein said lateral separation is approximately 1.40 times said width of the shank member.

6. An anchor according to claim 1, wherein the working surface of each fluke portion of the anchor to one side of the central plane of symmetry is arranged so that the centre of concave curvature for substantially all of the centres of concave curvature of sections of the working surface of said fluke portion or portions lying in planes normal to the intercept of said working surface with the central plane of symmetry are laterally spaced from the shank member on that fluke portion side of the anchor.

7. An anchor according to claim 1, wherein the fluke comprises a pair of concave side portions joined along a line in the plane of symmetry of the anchor.

8. An anchor according to claim 1, wherein the fluke comprises a substantially flat central portion and a pair of concave side portions joined to the central portion.

9. An anchor including a fluke having a burial surface thereon which in a vertical working burial attitude of the anchor is inclined relative to the horizontal to be penetrable into a mooring bed when dragged thereover whereby forces are developed by the burial surface to cause burial of the anchor, and a shank member located in a fore-and-aft plane of symmetry of the anchor and attached to the fluke and having an end adapted as a cable attachment point, the fluke having at either side of said plane of symmetry side portions with substantially conical upper working surfaces, upwardly extending normals from said working surfaces intercepting said plane of symmetry such that the fluke has a substantially concave upwardly facing working surface, the centres of curvature of transverse sections of said fluke side portions being located outside the part of the plane of symmetry which lies below and forward of at least a portion of the shank member so that, when the anchor is pulled through the mooring bed in a vertical burial attitude, the centre of the peak pressure focus zone produced in the mooring bed soil by the upper working surface of each fluke side portion, due to relative movement and consequential impingement of the soil thereof, is located substantially clear of the shank member and clear of the forward path of burial movement to be followed by the shank member in the soil.

10. An anchor according to claim 9, wherein the centres of the peak pressure focus zone produced by the fluke side portions on each side of the plane of symmetry are laterally separated about the said plane of symmetry.

11. An anchor according to claim 10, wherein the lateral separation of the centres of peak pressure in any cross-section of anchor and soil normal to the intercept of the working surface of the fluke with the central plane of symmetry is not less than 1.15 times the width of the shank member in such cross-section.

12. An anchor according to claim 11, wherein said lateral separation is approximately 1.30 times said width of the shank member.

13. An anchor according to claim 11, wherein said lateral separation is approximately 1.40 times said width of the shank member.

14. An anchor according to claim 9, wherein the working surface of each fluke portion of the anchor to one side of the central plane of symmetry is arranged so that the centre of concave curvature for substantially all of the centres of concave curvature of sections of the working surface of said fluke portion or portions lying in planes normal to the intercept of said working surface with the central plane of symmetry are laterally spaced from the shank member on that fluke portion side of the anchor.

15. An anchor according to claim 9, wherein the fluke comprises a pair of concave side portions joined along a line in the plane of symmetry of the anchor.

16. An anchor according to claim 9, wherein the fluke comprises a substantially flat central portion and a pair of concave side portions joined to the central portion.

* * * * *